US011536269B2

(12) United States Patent
Ishii et al.

(10) Patent No.: US 11,536,269 B2
(45) Date of Patent: Dec. 27, 2022

(54) TIP SEAL FOR SCROLL COMPRESSOR

(71) Applicant: NTN CORPORATION, Osaka (JP)

(72) Inventors: Takuya Ishii, Mie (JP); Daichi Ito, Mie (JP); Katsushi Takeo, Mie (JP); Satoru Fukuzawa, Mie (JP)

(73) Assignee: NTN CORPORATION, Osaka (JP)

( * ) Notice: Subject to any disclaimer, the term of this patent is extended or adjusted under 35 U.S.C. 154(b) by 346 days.

(21) Appl. No.: 16/484,419

(22) PCT Filed: Feb. 7, 2018

(86) PCT No.: PCT/JP2018/004250
§ 371 (c)(1),
(2) Date: Aug. 7, 2019

(87) PCT Pub. No.: WO2018/147338
PCT Pub. Date: Aug. 16, 2018

(65) Prior Publication Data

US 2019/0353162 A1 Nov. 21, 2019

(30) Foreign Application Priority Data

Feb. 7, 2017 (JP) ..... JP2017-020699
Oct. 17, 2017 (JP) ..... JP2017-200766
Jan. 31, 2018 (JP) ..... JP2018-015577

(51) Int. Cl.
*F04C 18/02* (2006.01)
*F04C 27/00* (2006.01)
*F01C 19/00* (2006.01)

(52) U.S. Cl.
CPC ..... *F04C 18/0261* (2013.01); *F04C 18/0215* (2013.01); *F04C 18/0284* (2013.01);
(Continued)

(58) Field of Classification Search
CPC ..... F04C 18/0261; F04C 18/0215; F04C 18/0284; F04C 27/002; F04C 27/005; F04C 18/0269; F01C 19/005
See application file for complete search history.

(56) References Cited

U.S. PATENT DOCUMENTS 5,035,589 A * 7/1991 Fraser, Jr. ..... F04C 27/00 418/1
6,193,487 B1 * 2/2001 Ni ..... F04C 23/001 277/398

(Continued)

FOREIGN PATENT DOCUMENTS

CN 105587665 A 5/2016
DE 102015119188 A1 5/2016

(Continued)

OTHER PUBLICATIONS

English Machine Translation of JP2003065266A. Espacenet on Jul. 24, 2021 (Year: 2003).*

(Continued)

*Primary Examiner* — Dominick L Plakkoottam
*Assistant Examiner* — Paul W Thiede
(74) *Attorney, Agent, or Firm* — Hedman & Costigan, P.C.; James V. Costigan; Kathleen A. Costigan

(57) ABSTRACT

A tip seal 1 for a scroll compressor capable of reducing a frictional force between scroll members and the tip seal where the tip seal 1 has a spiral shape for sealing a compression chamber formed between a fixed scroll and a movable scroll in a scroll compressor provided with the fixed scroll. The movable scroll having a plurality of concave parts 4 being formed by partially notching a sliding surface 5 on the scroll members, the concave parts 4 being arranged on at least one of a spiral inner peripheral surface 1*b* or a spiral outer peripheral surface 1*a*. Each of the (Continued)

concave parts 4 being open to the inner peripheral surface 1*b* or the outer peripheral surface 1*a*.

7 Claims, 15 Drawing Sheets

(52) U.S. Cl.
CPC ..... *F04C 27/002* (2013.01); *F04C 27/005* (2013.01); *F01C 19/005* (2013.01); *F04C 18/0269* (2013.01)

(56) References Cited

U.S. PATENT DOCUMENTS

| | | | | |
|---|---|---|---|---|
| 8,747,087 | B2 * | 6/2014 | Collie | F04C 27/005 418/55.4 |
| 2016/0131136 | A1 | 5/2016 | Crum | |

FOREIGN PATENT DOCUMENTS

| | | | | |
|---|---|---|---|---|
| GB | 2472776 | A | * 2/2011 | F04C 18/0284 |
| JP | 3-88985 | A | 4/1991 | |
| JP | 6-288361 | A | 10/1994 | |
| JP | 7-27060 | A | 1/1995 | |
| JP | 10-47266 | A | 2/1998 | |
| JP | 2002-322988 | A | 11/2002 | |
| JP | 2003-065266 | A | 3/2003 | |
| JP | 2007270762 | A | * 10/2007 | |

OTHER PUBLICATIONS

Derwent English Abstract of KR2006027920A (Year: 2006).*
English Machine Translation of JP2003-065266A translated by Espacenet (Year: 2003).*
English Machine Translation of JPH0727060A translated by Espacenet (Year: 1995).*
International Search Report for PCT/JP2018/004250 dated May 1, 2018.
Written Opinion of the International Searching Authority dated May 1, 2018.
English Abstract for JP 2002-322988 A dated Nov. 8, 2002.
English Abstract for JP 10-47266 A dated Feb. 17, 1998.
English Abstract for JP 7-27060 A dated Jan. 27, 1995.
English Abstract for JP 2003-065266 A dated Mar. 5, 2003.
English Abstract for JP 3-88985 A dated Apr. 15, 1991.
English Abstract for JP 6-288361 A dated Oct. 11, 1994.
English Machine Translation of Abstract for DE 102015119188 A1 dated May 12, 2016.
English Abstract for CN 105587665 A dated May 18, 2016.

* cited by examiner

TIP SEAL FOR SCROLL COMPRESSOR

TECHNICAL FIELD

The present invention relates to a tip seal in a spiral shape used in a scroll compressor.

BACKGROUND ART

In a scroll compressor, a fixed scroll and a movable scroll having a substrate and a spiral wall erected on the surface of the substrate are mutually engaged on each spiral wall and a compression chamber is formed therebetween. This compression chamber moves towards the spiral center side by the action of the movable scroll that revolves around an axis line of the fixed scroll thereby compressing gas and the like. In order to ensure sealability of the compression chamber upon compressing gas and the like, a seal groove is formed along a spiral extension direction on an end face of the spiral wall of the fixed scroll and the movable scroll serving as scroll members and a tip seal serving as a seal member that is in contact with an opposed scroll substrate (an end plate) is stored in the groove.

As to the tip seal, for example, a section thereof is produced into a spiral shape just like spirally winding a rectangular long member by injection molding a predetermined synthetic resin (refer to Patent Literature 1). As illustrated in FIG. 14, this kind of tip seal 71 is stored having a gap in a groove 72*a* of one lap (the spiral wall) 72 and is floated from a groove bottom 72*b* toward an end plate 73 between the groove 72*a* and the opposed end plate (the scroll substrate) 73 by the pressure of gas 74. The floated tip seal 71 is in sliding contact with the end plate 73 on a seal surface 71*a* that is a surface constituting the rectangle of the section and seals the compression chamber between each spiral wall.

PRIOR ART DOCUMENT

Patent Document

Patent Literature 1: Japanese Patent Application Laid-Open Publication No. 2002-322988

SUMMARY OF THE INVENTION

Problem to be Solved by the Invention

For achieving energy saving of the scroll compressor, it is important to reduce torque upon scrolling (operating) by reducing friction between the scroll member and the tip seal. However, in a case where the section of the tip seal has a rectangular shape, the sliding area of the tip seal and the scroll substrate is large and therefore the frictional force on the sliding surface becomes large.

The present invention has been made to deal with this problem. It is an object of the present invention to provide a tip seal for a scroll compressor capable of reducing the frictional force between the scroll members and the tip seal and contributing to energy saving of the scroll compressor while maintaining the sealing performance.

Means for Solving the Problem

The present invention provides a tip seal for a scroll compressor, in which a tip seal is in a spiral shape for sealing a compression chamber formed between a fixed scroll and a movable scroll in a scroll compressor provided with the fixed scroll and the movable scroll serving as scroll members including a plurality of concave parts formed by partially notching a sliding surface on the sliding surface for the scroll member. The concave parts are arranged on at least one of a spiral inner peripheral surface and a spiral outer peripheral surface and each of the concave parts opens to the inner peripheral surface or the outer peripheral surface and also does not penetrate through the inner peripheral surface or the outer peripheral surface.

A rate of a total area of the concave part to the sliding surface (total area of the concave part/(total area of the concave part+real sliding area)×100) is 5 to 45%.

A planar shape of the concave part is a circular arc shape or a substantially rectangular shape along a spiral shape.

A depth of the concave part is 45% or less of a thickness of the tip seal.

The concave parts are arranged on the sliding surface separately in a length direction from a winding-start end part to a winding-finish end part of the spiral of the tip seal, an opening length of each concave part is 1 to 20% of a developed length of the tip seal, and a portion between adjacent concave parts is a part of the sliding surface.

In addition, the areas in a planar shape of the concave parts are substantially the same between the concave parts. The concave parts are arranged on the sliding surface at equal intervals.

A planar shape of the concave part is a circular arc shape and circular arc radii of the concave parts that are arranged from a winding-start end part toward a winding-finish end part of the spiral of the tip seal are increased continuously or stepwise.

A tip seal for a scroll compressor of the present invention is a tip seal in a spiral shape for sealing a compression chamber formed between a fixed scroll and a movable scroll serving as the scroll members in a scroll compressor, in which the tip seal has a groove at the center part in a width direction of the tip seal at least on a sliding surface for the scroll member and the groove is formed over substantially the whole length of the tip seal.

A groove width of the groove is 1/20 to 2/5 of a width dimension of the tip seal.

The groove width is increased continuously or stepwise from a winding-start end part toward a winding-finish end part of the spiral of the tip seal.

A groove depth of the groove is 35% or less of a thickness of the tip seal.

The groove is provided with an opening part connecting to the groove on any one of the spiral inner peripheral surface and the spiral outer peripheral surface.

The opening part has a concave shape formed by notching the sliding surface and a plurality of the opening parts are arranged separately in a length direction from a winding-start end part toward a winding-finish end part of the spiral of the tip seal.

The tip seal is made of a synthetic resin.

Effects of the Invention

Since the tip seal for a scroll compressor of the present invention is a tip seal in a spiral shape for sealing the compression chamber formed between the fixed scroll and the movable scroll serving as the scroll members and includes the concave parts formed by partially notching a sliding surface on the sliding surface for the scroll member, the sliding area becomes small and a surface pressure increases and therefore the frictional force on the sliding surface can be reduced. As a result, it is possible to reduce torque of the scroll members upon scrolling in the scroll compressor and contribute to energy saving of the compressor. In addition, since the concave parts on the sliding surface are arranged on at least one of the spiral inner peripheral surface and the spiral outer peripheral surface and each of the concave parts opens to the inner peripheral surface or the outer peripheral surface and also does not penetrate through the inner peripheral surface or the outer peripheral surface, it is possible to supply a lubricant such as a refrigerating machine oil to the sliding surface and further reduce the frictional force on the sliding surface while maintaining the seal performance.

Since the rate of the total area of the concave parts to the sliding surface (total area of the concave parts/(total area of the concave parts+real sliding area)×100) is 5 to 45%, the frictional force on the sliding surface is reduced and a deterioration in mechanical strength is suppressed.

Since the planar shape of the concave part is a circular arc shape or a substantially rectangular shape along a spiral shape, a design and an arrangement of the concave part are facilitated. In particular, in a case where the concave parts are arranged, a design such that the areas of the concave parts are made to be substantially the same between the concave parts is facilitated.

Since the depth of the concave part is 45% or less of a thickness of the tip seal, the sealing performance can be sufficiently secured while being provided with the concave parts formed by partially notching the sliding surface.

Since the concave parts are arranged on the sliding surface separately in a length direction from the winding-start end part to the winding-finish end part of the spiral of the tip seal, each opening length of the concave parts is 1 to 20% of a developed length of the tip seal, and a portion between adjacent concave parts is a part of the sliding surface, the sliding area becomes small and therefore the frictional force on the sliding surface can be further reduced.

In addition, since the areas in a planar shape of the concave parts are substantially the same, a difference in frictional force between seal portions becomes small and therefore the scroll members can be stably scrolled. In addition, since the concave parts are arranged on the sliding surface at equal intervals, the scroll members can be stably scrolled in the same way as mentioned above.

Since the planar shape of the concave part is a circular arc shape and circular arc radii of the concave parts that are arranged from the winding-start end part toward the winding-finish end part of the spiral of the tip seal are increased continuously or stepwise, the areas of the planar shape of the concave parts can be made to be substantially the same between the concave parts while making the opening lengths of the concave parts and the like to be almost the same.

Since the tip seal for a scroll compressor of the present invention is a tip seal in a spiral shape for sealing the compression chamber formed between the fixed scroll and the movable scroll serving as the scroll members, the tip seal has a groove at the center part in a width direction of the tip seal at least on the sliding surface for the scroll member, and the groove is formed over substantially the whole length of the tip seal, the sliding area becomes small and a surface pressure increases and therefore the frictional force on the sliding surface can be reduced. As a result, it is possible to reduce torque of the scroll members upon scrolling in the scroll compressor and contribute to energy saving of the compressor. In addition, since the groove also serves as a lubricating groove, it becomes possible to supply a lubricating oil such as a refrigerating machine oil onto the sliding surface.

Since a groove width of the groove is 1/20 to 2/5 of a width dimension of the tip seal, the mechanical strength of the seal can be ensured while maintaining the sealing performance. Moreover, since the groove width is increased from the winding-start end part toward the winding-finish end part of the spiral of the tip seal continuously or stepwise, the sliding area becomes even smaller on the spiral outer peripheral part side while maintaining high sealing performance on the spiral inner peripheral part side and therefore the frictional force on the sliding surface can be further reduced.

Since a groove depth of the groove is 35% or less of a thickness of the tip seal, a deterioration in mechanical strength of the seal is prevented and therefore the sealing performance can be sufficiently secured.

Since the groove is provided with the opening part connecting to the groove on any one of the spiral inner peripheral surface and the spiral outer peripheral surface, a lubricating oil is introduced from the opening part to the groove while maintaining the sealing performance and therefore the frictional force on the sliding surface can be further reduced. Moreover, since the opening part has a concave shape formed by notching the sliding surface and the opening parts are arranged separately in a length direction from the winding-start end part to the winding-finish end part of the spiral of the tip seal, the supply property of a lubricating oil into the groove can be enhanced.

Since the tip seal is made of a synthetic resin, the tip seal is excellent in low friction characteristics and non-attackability to a contact surface of a mating member thereby being capable of contributing to a long service life of the scroll compressor.

MODE FOR CARRYING OUT THE INVENTION

First Embodiment

Figure 6:
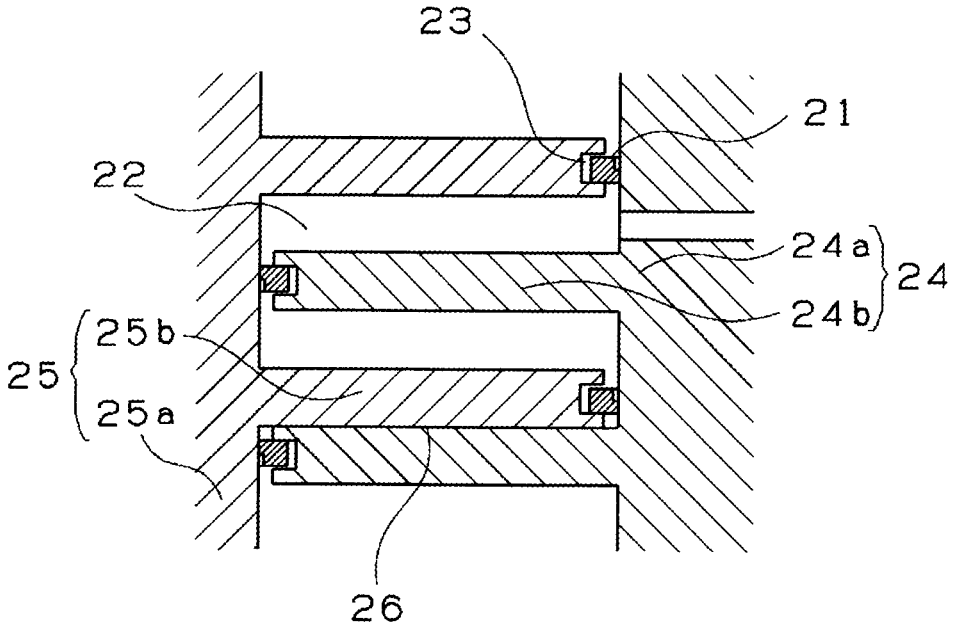
FIG. 6 is a partial sectional view of a compressor mechanism part in a scroll compressor.

One example of a structure of a compressor mechanism part in a scroll compressor applying a tip seal in a first embodiment will be explained based on FIG. 6. FIG. 6 is a partial sectional view of a compressor mechanism part in a scroll compressor. As illustrated in FIG. 6, the scroll compressor is provided with a fixed scroll 24 having a substrate 24*a* and a spiral wall 24*b* erected on the surface thereof and a movable scroll 25 having a substrate 25*a* and a spiral wall 25*b* erected on the surface thereof. The fixed scroll 24 and the movable scroll 25 are meshed with each other in an eccentric state at a spiral wall boundary 26 and a compression chamber 22 is formed therebetween. By the movable scroll 25 revolving around an axis line of the fixed scroll 24, the compression chamber 22 is moved to a center side in a spiral shape to compress gas and the like. A seal groove 23 is formed on an end face of the spiral wall of the fixed scroll 24 and the movable scroll 25 along a spiral extension direction. A tip seal 21 in the first embodiment is stored in the seal groove 23 and is in sliding contact with an opposed scroll substrate to ensure sealability of the compression chamber 22.

Figure 1:
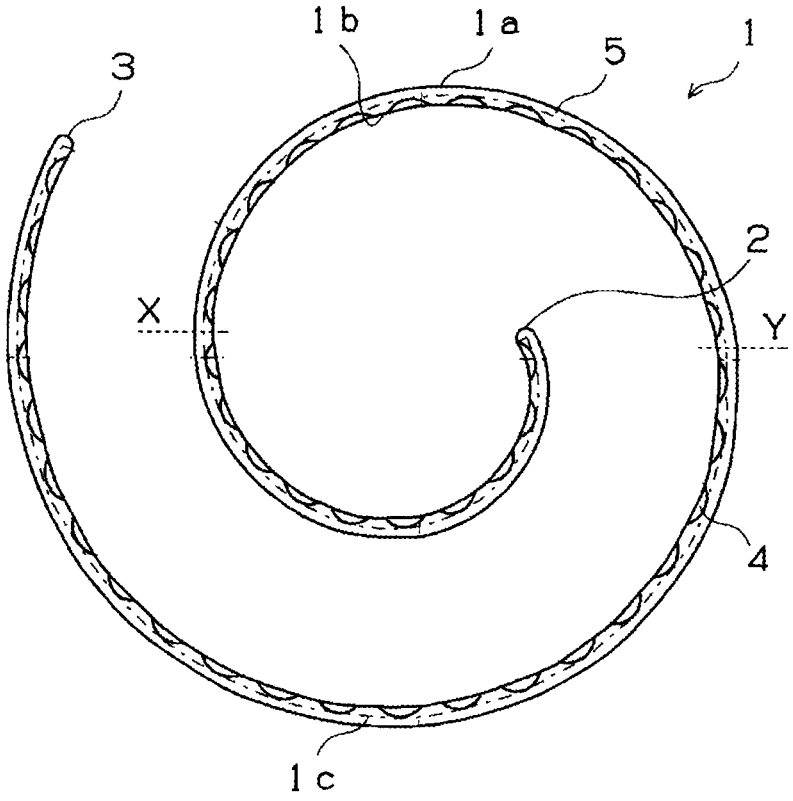
FIG. 1 is a planar view illustrating one example of a tip seal of a first embodiment.
Figure 2:
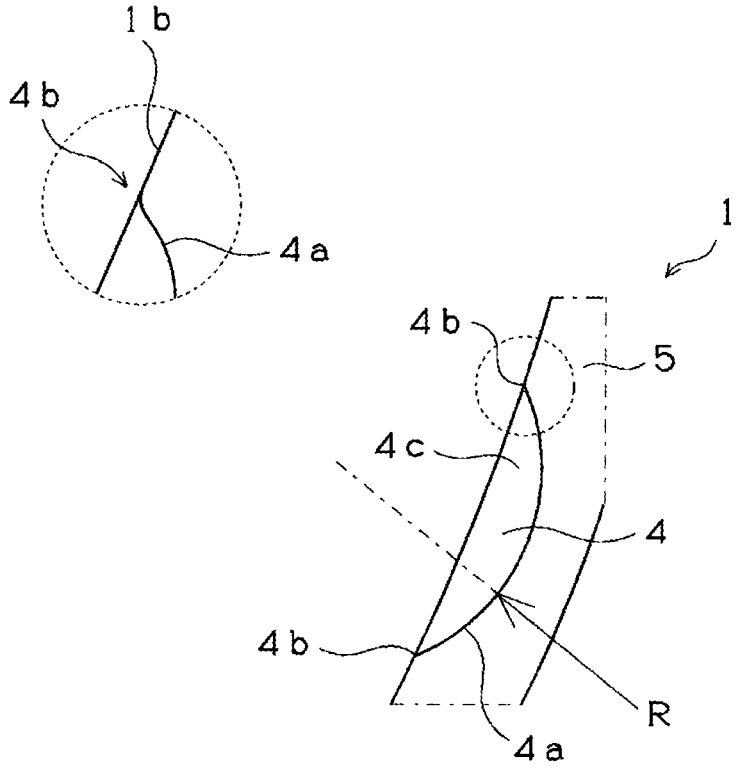
FIG. 2 is an enlarged view around a concave part in FIG. 1.
Figure 3:
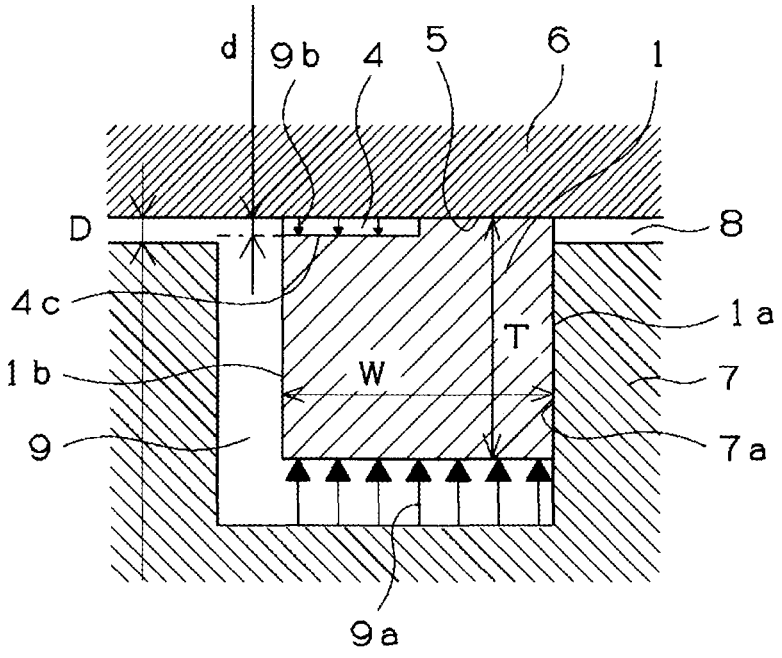
FIG. 3 is a sectional view of a state in which a tip seal is incorporated into a compressor.

One example of the tip seal for a scroll compressor in the first embodiment will be explained based on FIG. 1 to FIG. 3. FIG. 1 is a planar view viewing the tip seal in the first embodiment from the side of the sliding surface for a mating scroll member, serving as a seal surface, FIG. 2 is a partial enlarged view thereof, and FIG. 3 is a sectional view of a state in which the tip seal is incorporated into a compressor. As illustrated in FIG. 1, a tip seal 1 has a spiral shape just like spirally winding a long member whose section has a substantially rectangular shape. The spiral shape is a shape whose curvature radius is gradually increased from a winding-start end part 2 toward a winding-finish end part 3. A sliding surface 5 is a sliding surface for an opposed scroll substrate and serves as a seal surface to seal gas and the like in the compression chamber.

The tip seal 1 has a plurality of concave parts 4 formed by partially notching the sliding surface 5 on the sliding surface 5 for the scroll member. The concave parts 4 are arranged on a spiral inner peripheral surface 1*b*. The concave parts 4 may have a configuration arranging on an outer peripheral surface 1*a* or may also have a configuration arranging on both inner peripheral surface 1*b* and outer peripheral surface 1*a*. Each of the concave parts opens to the inner peripheral surface 1*b* or the outer peripheral surface 1*a* and also does not penetrate through the inner peripheral surface 1*b* or the outer peripheral surface 1*a*. In other words, in the tip seal 1 in which the concave parts 4 are formed, the concave parts arranged on the inner peripheral surface 1*b* do not penetrate through the outer peripheral surface 1*a* and the concave parts arranged on the outer peripheral surface 1*a* do not penetrate through the inner peripheral surface 1*b*. By making the concave parts 4 into a shape in which an edge part of the sliding surface 5 is notched to open to the inner peripheral surface 1*b* or the outer peripheral surface 1*a*, without the concave parts 4 being closed in the sliding surface, a lubricating oil such as a refrigerating machine oil can be introduced into the concave parts thereby becoming easy to supply a lubricating oil onto the sliding surface. In addition, by the concave parts 4 opening only to either the spiral inner peripheral surface 1*b* or the outer peripheral surface 1*a* and also not penetrating through the inner peripheral surface 1*b* and the outer peripheral surface 1*a*, the sealing performance can also be secured.

Furthermore, since the rate of the total area of the concave parts to the sliding surface (total area of the concave parts/(total area of the concave parts+real sliding area)×100) is 5 to 45%, the frictional force on the sliding surface can be effectively reduced. In a case where the rate of the total area of the concave parts on the sliding surface is less than 5%, the surface pressure of the sliding surface cannot effectively increase and therefore a reducing effect of the frictional force is poor. In addition, when the rate is more than 45%, a gas pressure from the concave parts increases and a gas pressure from an anti-seal surface is offset thereby reducing the surface pressure on the sliding surface and therefore a reducing effect of the frictional force becomes poor. The rate of the total area of the concave parts on the sliding surface is preferably 7 to 40% and more preferably 10 to 35%. The real sliding area is an area excluding the area of the concave parts from the area of the sliding surface.

In a configuration illustrated in FIG. 1, the concave parts 4 (the number thereof is 44 in FIG. 1) are separately arranged side by side on the sliding surface 5 in a length direction from the winding-start end part 2 to the winding-finish end part 3 of the spiral of the tip seal 1. A portion between adjacent concave parts 4 is a part of the sliding surface 5 (the seal surface). The number of concave parts is not particularly limited and is appropriately set in consideration of the size of each concave part. For example, the number thereof is set to 10 to 50 and preferably 30 to 50. It is preferable to arrange the concave parts 4 at equal intervals on the sliding surface 5. Thus, a difference in frictional force between the seal portions becomes small and therefore the scroll members can be stably scrolled.

The opening length of each concave part 4 is preferably 1 to 20%, more preferably 1 to 10%, and even more preferably 1 to 5% of a developed length of the tip seal. By making the opening length to be smaller, a larger number of concave parts can be arranged. For example, when comparing a case of arranging long concave parts with a small number thereof along the spiral with a case of arranging a plurality of short concave parts, even when the total areas of the concave parts are the same, the latter is more preferable than the former, because a deformation of the tip seal and the like are easily suppressed and the sealing performance is excellent. The developed length of the tip seal means a length developing a long member in a spiral shape and this is a total length of a center line 1*c* connecting the central positions in a width W direction of the tip seal (a position at an equal distance from the inner peripheral surface and the outer peripheral surface) in a planar view in FIG. 1. In addition, the opening length of the concave part in a circular arc shape means a maximum length of a circular arc of the concave part opening to the inner peripheral surface or the outer peripheral surface (a length between 4*b* and 4*b* along the inner peripheral surface 1*b* in FIG. 2).

As illustrated in FIG. 2, the planar shape of the concave part 4 is a circular arc shape. As illustrated in FIG. 3, the sectional shape of the concave part 4 is a rectangle. Accordingly, the concave part 4, whose planar shape is a circular arc shape, has a shape vertically formed from the sliding surface 5 to a certain depth. Therefore, as to the concave part 4, the planar shape of the sliding surface 5 is the same as the planar shape of the deepest part 4*c*. A circular arc radius R (refer to FIG. 2) of the circular arc surface 4*a* and a center position thereof are not particularly limited, but it is preferable that the concave part is set in a position not exceeding the central position in a width direction of the tip seal. For example, in a case where the size of the tip seal (substantially the outer diameter of the spiral) is 70 mm, the radius R is preferably set to R2 mm to R4 mm. By providing with the concave parts so as not to exceed the central position, high sealing performance can be maintained.

A depth d of the concave part 4 (refer to FIG. 3) is preferably 45% or less, more preferably 30% or less, and even more preferably 15% or less of a thickness of the tip seal. A thickness T of the tip seal is a distance between the seal surface serving as the sliding surface and the anti-seal surface. By setting the depth of the concave part 4 to 45% or less of a thickness of the tip seal, the rigidity of the tip seal is maintained and the frictional force on the sliding surface can be moderately reduced even if wear progresses. Thus, sufficient sealing performance can be secured while being provided with the concave parts formed by partially notching the sliding surface to reduce the frictional force.

In addition, as illustrated in an enlarged view in FIG. 2, a boundary part 4*b* of the inner peripheral surface 1*b* and the circular arc surface 4*a* of the spiral is preferably made to be an R shape (for example, R0.5 mm or less). By providing with such an R shape, when the inner peripheral surface is in sliding contact with the seal groove, an edge of the boundary part can be eliminated and a lubricating oil such since a refrigerating machine oil is easily introduced into the concave part and therefore a stable lubrication state can be maintained and a local deformation of the tip seal can be surpassed.

It is preferable that the areas in a planar shape of the concave parts 4 are substantially the same between the concave parts. Thus, a difference in frictional forces between the seal portions becomes small and therefore the scroll members can be stably scrolled. As illustrated in FIG. 1, since the tip seal 1 in the first embodiment has a spiral shape, it has a shape whose curvature radius is gradually increased from the winding-start end part 2 toward the winding-finish end part 3. Therefore, it is impossible to unify the concave parts 4 to a single circular arc shape to make each area in a planar shape thereof to be the same. Accordingly, it is preferable that the circular arc radii of the concave parts that are arranged from the winding-start end part toward the winding-finish end part of the spiral of the tip seal are increased continuously or stepwise, in order to make the areas in a planar shape of the concave parts to be substantially the same between the concave parts, while making the opening lengths of the concave parts and the like to be almost the same. In a configuration illustrated in FIG. 1, by dividing into three steps of (1) from the winding-start end part 2 to X, (2) from X to Y, and (3) from Y to the winding-finish end part 3, the circular arc radii of the concave parts are increased stepwise.

The tip seal 1 is a seal member for sealing the compression chamber formed between the spiral walls of the fixed scroll and the movable scroll serving as the scroll members in the scroll compressor. As illustrated in FIG. 3, the tip seal 1 is stored in the seal groove of a spiral wall 7 and is in sliding contact with an opposed scroll substrate 6 to seal the compression chamber. The spiral wall 7 is opposed to the scroll substrate 6 with a gap 8 (with a distance D). As to a relation between the depth d of the concave part 4 and the distance D of the gap 8, it is preferable that they are substantially the same or the depth d of the concave part 4 is slightly smaller than the distance D of the gap 8. The tip seal 1 is stored having a gap in the seal groove of the spiral wall 7 and is floated from a seal groove bottom toward the scroll substrate 6 between the tip seal 1 and the opposed scroll substrate 6 by the pressure of gas 9. The floated tip seal 1 is in sliding contact with the scroll substrate 6 on the seal surface 5 and a seal groove wall 7*a* of the spiral wall 7 on the outer peripheral surface 1*a* to seal the compression chamber between each spiral wall 7 of the fixed scroll and the movable scroll serving as the scroll members and the spiral wall of the scroll substrate 6.

Figure 14:
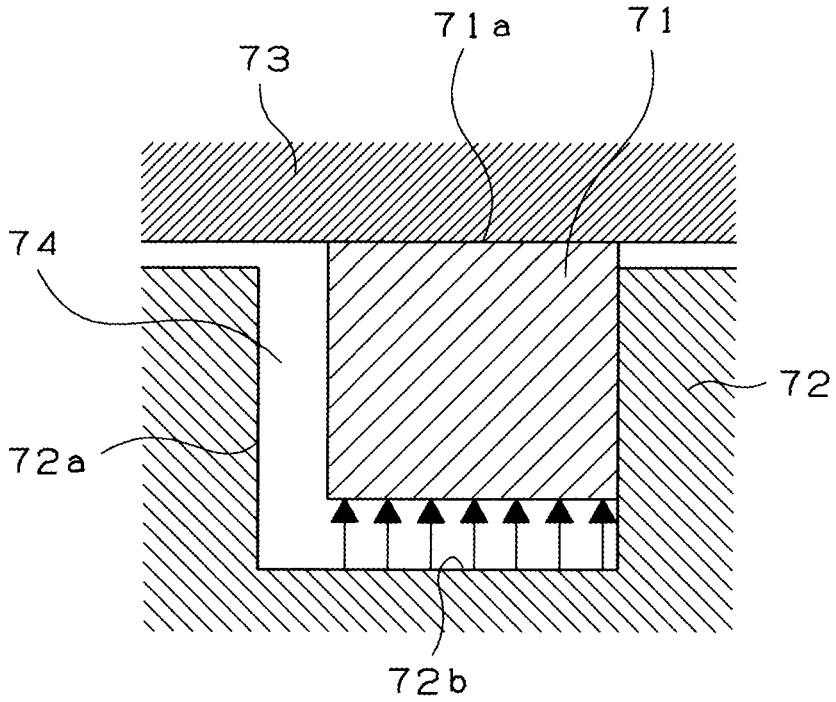
Fig.14 PRIOR ART
FIG. 14 is a sectional view of a state in which a conventional tip seal is incorporated into a compressor.
Figure 15:
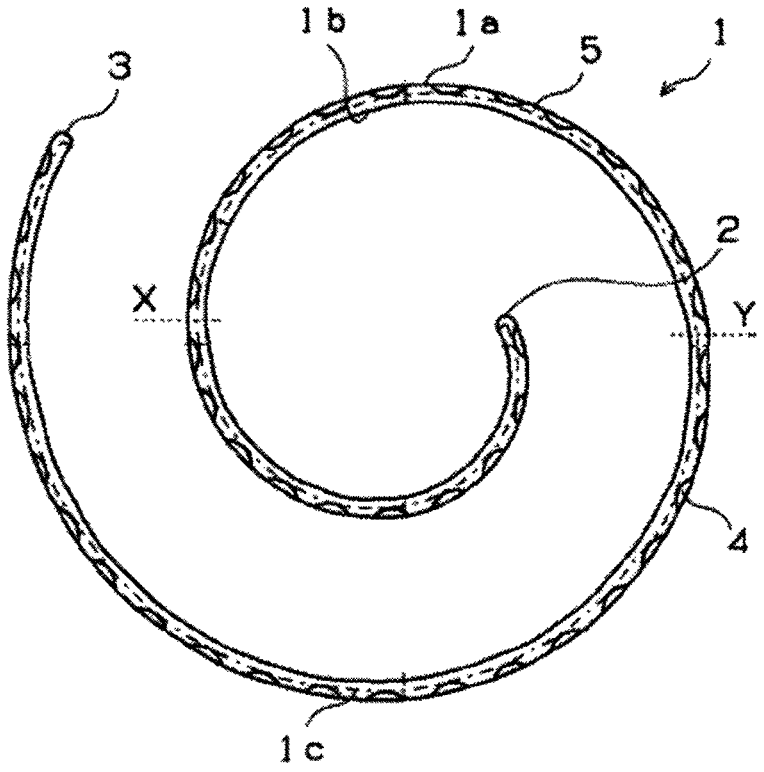
FIG. 15 is a view illustrating one example of an alternate embodiment of a tip seal.

Since the tip seal 1 includes the concave parts 4 described above on the sliding surface 5, gas 9 in the compression chamber can be partly introduced into these concave parts 4. The arrows 9*a* and 9*b* in the figure indicate the pressure that each surface receives from gas 9. The sliding area itself becomes smaller than that of a conventional product without the concave part (FIG. 14), due to the concave part 4 formed by partially notching the sliding surface 5. The dimension of the tip seal (the number of concave parts is 44) in the present embodiment illustrated in FIG. 1 to FIG. 3 is the same as that of the tip seal of a conventional product illustrated in FIG. 14, except for the presence or absence of the concave part. In this case, when the real sliding area of the conventional product is taken as 100, the real sliding area in the present embodiment is 75 and the rate of the total area of the concave parts to the sliding surface (total area of the concave parts/(total area of the concave parts+real sliding area)×100) is 25%. Since the real sliding area becomes smaller, the surface pressure applied onto the sliding surface becomes higher thereby reducing a friction coefficient. As a result, the frictional force on the sliding surface is reduced. In addition, as illustrated as the pressure of the gas described above, in the present embodiment, the gas pressure in which the anti-seal surface of the tip seal 1 receives is partly offset by the gas pressure that has been introduced into the concave part 4. However, since a lubricating oil such as a refrigerating machine oil is easily supplied onto the sliding surface, the frictional force can be greatly reduced on the sliding surface, compared with the conventional product. The rate of the total area of the concave parts to the sliding surface (total area of the concave parts/(total area of the concave parts+real sliding area)×100) is 5 to 45%. When the rate is higher than 45%, the surface pressure applied onto the sliding surface is consequently reduced by gas that has been introduced into the concave part 4.

Figure 4:
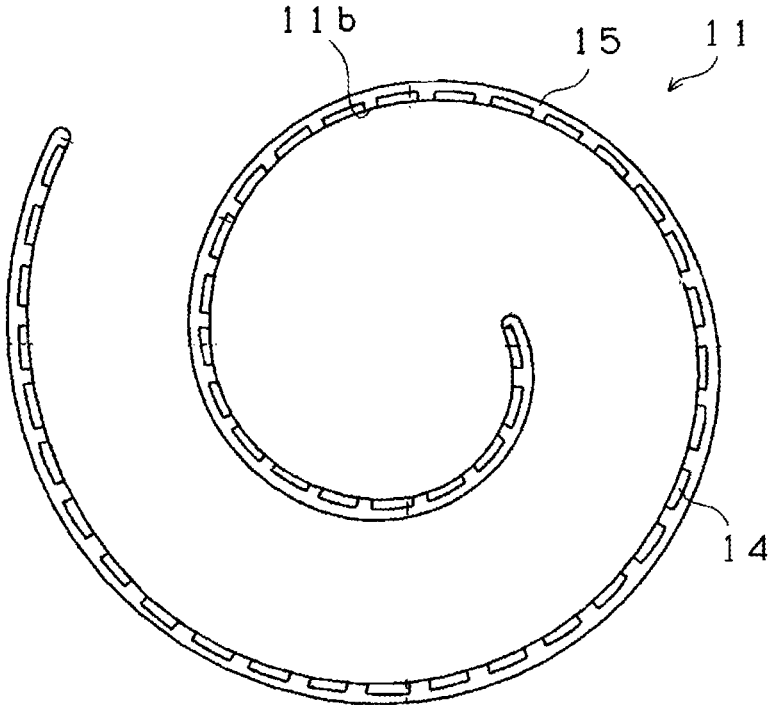
FIG. 4 is a planar view illustrating another example of a tip seal of the first embodiment.
Figure 5:
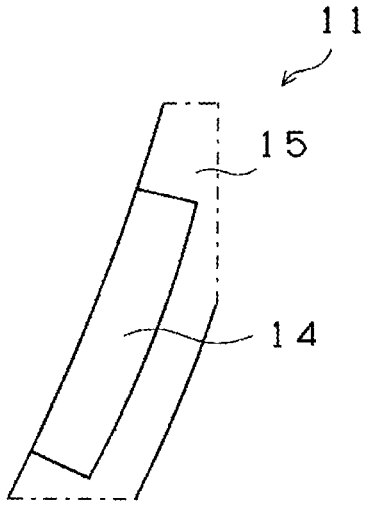
FIG. 5 is an enlarged view around a concave part in FIG. 4.

Another example of the tip seal for a scroll compressor in the first embodiment will be explained based on FIG. 4 and FIG. 5. FIG. 4 is a planar view viewing the tip seal of the present embodiment from the sliding surface side for the mating scroll member, serving as the seal surface and FIG. 5 is a part of an enlarged view thereof. As illustrated in FIG. 4 and FIG. 5, a tip seal 11 includes a plurality of concave parts 14 formed by partially notching a sliding surface 15 on the sliding surface 15 for the scroll members. The shape of the concave parts is a substantially rectangular shape along a spiral shape. Both long sides of the rectangle are formed in a curve along the spiral shape, the concave parts are arranged on a spiral inner peripheral surface 11*b*, and one side of the rectangular long side of each of the concave parts opens to the spiral inner peripheral surface 11*b*.

The number of the concave parts, the opening length of each concave part, the depth of each concave part, and the like are the same as those of the concave parts in a circular arc shape illustrated in FIG. 2. As to the planar shape, it is preferable that the concave part is set in a position not exceeding a central position in a width direction of the tip seal.

As mentioned above, by making the planar shape of the concave part into a circular arc shape or a substantially rectangular shape along the spiral shape, a design and an arrangement of the concave part are facilitated and, in particular, in a case where the concave parts are arranged, a design such that the areas thereof are made to be substantially the same is facilitated. In addition, the tip seal having the concave parts on the sliding surface has been explained based on each figure, but the present embodiment is not limited thereto, and, particularly, as to the shape of the concave part, an arbitrary shape may be used as long as the concave parts are the concave parts formed by partially notching the sliding surface, the concave parts are arranged on at least one of the spiral inner peripheral surface and the spiral outer peripheral surface, and each of the concave parts opens to the inner peripheral surface or the outer peripheral surface and also does not penetrate through the inner peripheral surface or the outer peripheral surface. For example, the depth of the concave part is not set to a certain depth and the shape of the deepest part may be formed into an inclined surface like a hemispherical shape and a tapered shape, which widens toward the opening side.

Second Embodiment

Next, one example of a structure of a compressor mechanism part in a scroll compressor applying a tip seal in a second embodiment will be explained based on FIG. 13.

Figure 13:
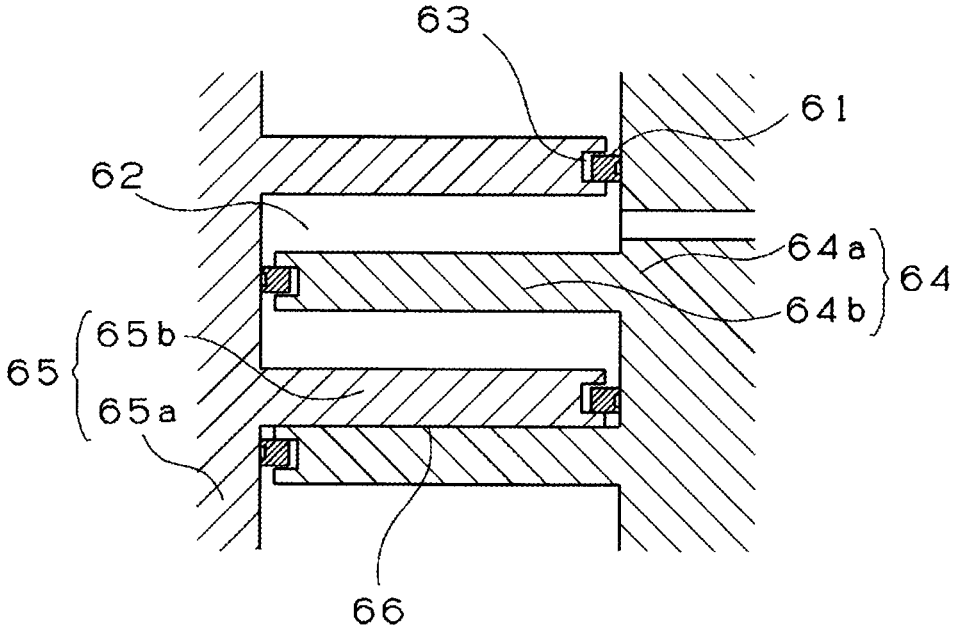
FIG. 13 is a partial sectional view of a compressor mechanism part in a scroll compressor.

FIG. 13 is a partial sectional view of a compressor mechanism part in a scroll compressor. As illustrated in FIG. 13, the scroll compressor is provided with a fixed scroll 64 having a substrate 64*a* and a spiral wall 64*b* erected on the surface thereof and a movable scroll 65 having a substrate 65*a* and a spiral wall 65*b* erected on the surface thereof. The fixed scroll 64 and the movable scroll 65 are meshed with each other in an eccentric state at a spiral wall boundary 66 and a compression chamber 62 is formed therebetween. By the movable scroll 65 revolving around an axis line of the fixed scroll 64, the compression chamber 62 is moved to a center side in a spiral shape to compress gas and the like. A seal groove 63 is formed on an end face of the spiral wall of the fixed scroll 64 and the movable scroll 65 along a spiral extension direction. A tip seal 61 in the second embodiment is stored in the seal groove 63 in the same way as the tip seal in the first embodiment and is in sliding contact with an opposed scroll substrate to ensure sealability of the compression chamber 62.

Figure 7:
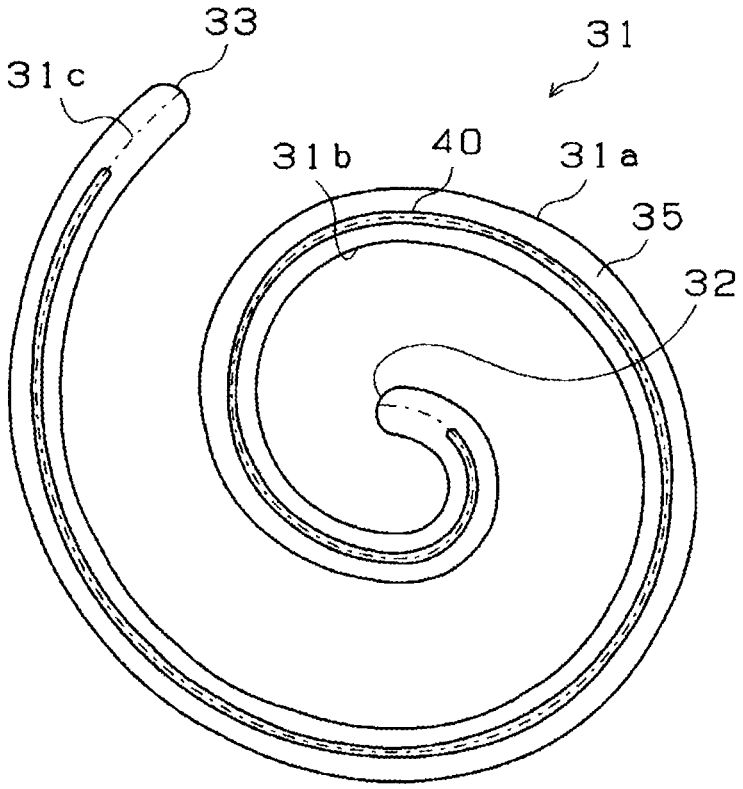
FIG. 7 is a planar view illustrating one example of a tip seal of a second embodiment.
Figure 8:
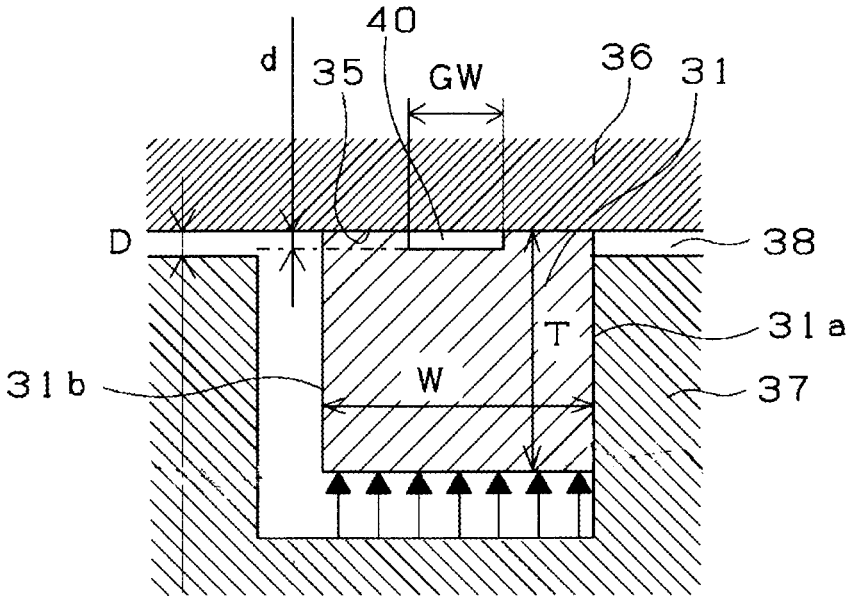
FIG. 8 is a sectional view of a state in which a tip seal is incorporated into a compressor.

One example of a tip seal for a scroll compressor in the second embodiment will be explained based on FIG. 7 and FIG. 8. FIG. 7 is a planar view viewing the tip seal in the second embodiment from the side of the sliding surface, serving as the seal surface, for the mating scroll member and FIG. 8 is a sectional view of a state in which the tip seal is incorporated into a compressor. A tip seal 31 is a seal member for sealing the compression chamber formed between the spiral walls of the fixed scroll and the movable scroll serving as the scroll members in the scroll compressor. As illustrated in FIG. 7, the tip seal 31 has a spiral shape just like spirally winding a long member whose section is a substantially rectangular shape. The spiral shape is a shape whose curvature radius is gradually increased from a winding-start end part 32 toward a winding-finish end part 33. A sliding surface 35 is a sliding surface for an opposed scroll substrate and serves as a seal surface to seal gas and the like in the compression chamber.

In FIG. 7, as to the tip seal 31, the groove 40 is formed on the sliding surface 35 for the scroll member over substantially the whole length of the tip seal 31. The groove 40 does not open to a spiral inner peripheral surface 31*b* and a spiral outer peripheral surface 31*a* and is the concave groove closed in the sliding surface. In addition, the groove 40 is provided at substantially the center part in a width W direction of the tip seal 31. In FIG. 7, the groove 40 is symmetrically formed around a center line 31*c* connecting the central positions in a width W direction of the tip seal 31 (a position at an equal distance from the inner peripheral surface and the outer peripheral surface) as a center. In this way, by providing with the groove 40 on the sliding surface 35, the sliding area is reduced and it is possible to hold a lubricating oil in the groove and secure lubricity.

The groove on the sliding surface is provided over substantially the whole length of the tip seal. In the second embodiment, a state over substantially the whole length includes not only a continuous state from the winding-start end part 32 to the winding-finish end part 33 of the tip seal, but also a discontinuous state. For example, as illustrated in FIG. 7, there may be a part in which the groove 40 is not formed on the side of the winding-start end part 32 and the side of the winding-finish end part 33 on the sliding surface 35. In addition, as illustrated in FIG. 7, the groove 40 may be one continuous concave groove and may be two or more concave grooves divided in a length direction of the spiral of the tip seal 31.

In the second embodiment, since the groove is formed over substantially the whole length of the tip seal, the length of the groove (the total length as to the concave groove that is divided into two or more) in a length direction of the spiral of the tip seal is a length of 60% or more, preferably a length of 70% or more, and even more preferably a length of 80% or more, relative to the developed length of the tip seal. In particular, as the groove, one concave groove having a length of 80% or more, relative to the developed length of the tip seal is preferable. The developed length of the tip seal means a length developing long member in a spiral shape and this is a length of a center line 31*c* in FIG. 7.

Figure 9:
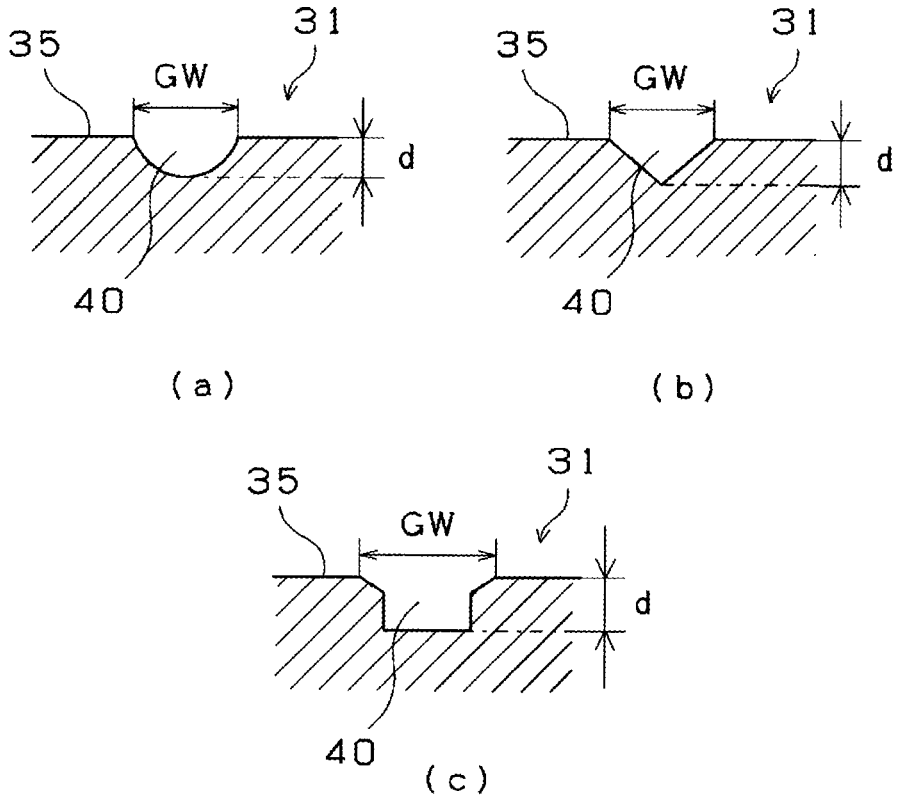
FIG. 9 is a view illustrating a sectional shape of a groove.

The groove in a sectional shape is an angular groove having a rectangular shape in FIG. 8, but the shape thereof is not particularly limited as long as it has a shape capable of holding a lubricating oil. Another sectional shape of the groove 40 applied to the tip seal 31 is illustrated in FIG. 9. For example, as the groove, a groove in a circular arc shape in FIG. 9(*a*), a V groove in FIG. 9(*b*), an angular groove in which both side surfaces have a tapered shape in FIG. 9(*c*), and the like may be employed. Among those, since a lubricating oil is smoothly supplied onto the sliding surface 35, it is preferable to use the groove in a circular arc shape or the V groove. These sectional shapes of the groove can be also applied to a tip seal 41 and a tip seal 51 described later.

In FIG. 8, a groove depth d of the groove 40 is preferably 35% or less, more preferably 30% or less, and even more preferably 15% or less of a thickness of the tip seal. A thickness of the tip seal T is a distance between the seal surface serving as the sliding surface and the anti-seal surface. By setting the groove depth d to 35% or less of a thickness of the tip seal, the rigidity of the tip seal is maintained, the frictional force on the sliding surface can be moderately reduced even if wear progresses, and moreover, the sealing performance is maintained without occurring a deformation of the seal surface. Thus, sufficient sealing performance can be secured while reducing the frictional force. The groove depth d refers to a maximum depth from the sliding surface 35 in the groove 40. For example, the groove depth d in each groove in FIG. 9 is as illustrated in the figure.

As illustrated in FIG. 8, the tip seal 31 is stored in the seal groove on a spiral wall 37 and is in sliding contact with an opposed scroll substrate 36 to seal the compression chamber. In FIG. 8, the scroll substrate 36 and the spiral wall 37 are the scroll members (the fixed scroll or the movable scroll), and one scroll member provided with the seal groove is set to the spiral wall 37 and the other scroll member is set to the substrate 36. The spiral wall 37 is opposed to the scroll substrate 36 having a gap 38 (with a distance D). As to a relation between the groove depth d and the distance D of the gap 38, it is preferable that they are substantially the same or the groove depth d is slightly smaller than the distance D of the gap 38.

A groove width GW of the groove 40 (refer to FIG. 8) is set to 1/20 to 2/5 and is preferably set to 1/20 to 1/3 of a width dimension of the tip seal. A width dimension of the tip seal W (hereinafter, also refer to as a seal width) is a length between the inner peripheral surface and the outer peripheral surface. The groove width GW of the groove 40 needs to be 0.1 mm or more in the actual size. The maximum value in the actual size does not need to be set. In a case where the groove width GW is less than 1/20 of the seal width or less than 0.1 mm, it is difficult to effectively raise the surface pressure of the tip seal and therefore there is a possibility that a reducing effect of a friction coefficient does not be obtained. On the other hand, the maximum width of the groove width GW is set to not more than 2/5 of the seal width thereby ensuring the sealing performance and the mechanical strength. The groove width GW is a length in a width direction of the tip seal at a part opening to the sliding surface 35 and, for example, the groove width GW in each groove in FIG. 9 is as illustrated in the figure.

The seal width of the tip seal is related to a volume of the compressor and is in a range of approximately 2 to 5 mm. For example, in a case where the seal width is 2 mm, the minimum width of the groove is 1/20 of the seal width and 0.1 mm in the actual size. In addition, in a case where the seal width is 1 mm, the minimum width of the groove is 0.1 mm in the actual size (1/10 of the seal width). In this case, the maximum width of the groove is 0.40 mm, which is 2/5 of the seal width.

The groove width of the groove 40 is constant over substantially the whole length of the tip seal 31 in FIG. 7. For example, the groove width is not set to be constant and may be set so as to be different from the winding-start end part 32 toward the winding-finish end part 33. In this case, in consideration of a pressure distribution of gas being compressed, it is preferable to set the groove width so as to be different. Since the scroll compressor gradually compresses gas from the spiral outer peripheral part side toward the spiral inner peripheral part side (center side), the pressure of gas being compressed is higher at the inner peripheral part side than at the outer peripheral part side. For example, since the outer peripheral part side is in a state in which most of the gas sucked from a suction pipe (not illustrated in the figure) is not compressed, a pressure difference between a high pressure side and a low pressure side separated by the tip seal is not so large. Therefore, it is thought that the sufficient seal function for compressing can be exhibited without giving not so high sealing performance to the tip seal at the outer peripheral part side. On the other hand, since a pressure difference between a high pressure side and a low pressure side is large at the inner peripheral part side, it is thought that high sealing performance is required for the tip seal.

In consideration of the pressure distribution, in order to make the groove widths different, the groove width is preferably increased continuously or stepwise from the winding-start end part toward the winding-finish end part of the spiral in a constitution provided with the groove. For example, in tip seal 41 in FIG. 10, a groove 50 is constituted by dividing into two parts in a length direction of the tip seal. In this case, GW2 is larger than GW1 where GW1 is the groove width of a groove 50*a* at the inner peripheral part side and GW2 is the groove width of a groove 50*b* at the outer peripheral part side. With this constitution, the sliding area is reduced by providing with the groove over substantially the whole length, and moreover, the sliding area can be further reduced by making the groove width to be larger at the outer peripheral part side and high sealing performance can be ensured by making the groove width to be relatively smaller at the inner peripheral part side.

As another constitution, such constitution may be used that the groove width is increased stepwise by dividing into three steps or more from the winding-start end part toward the winding-finish end part in one groove. In addition, such constitution may also be used that the groove width is increased continuously.

Figure 10:
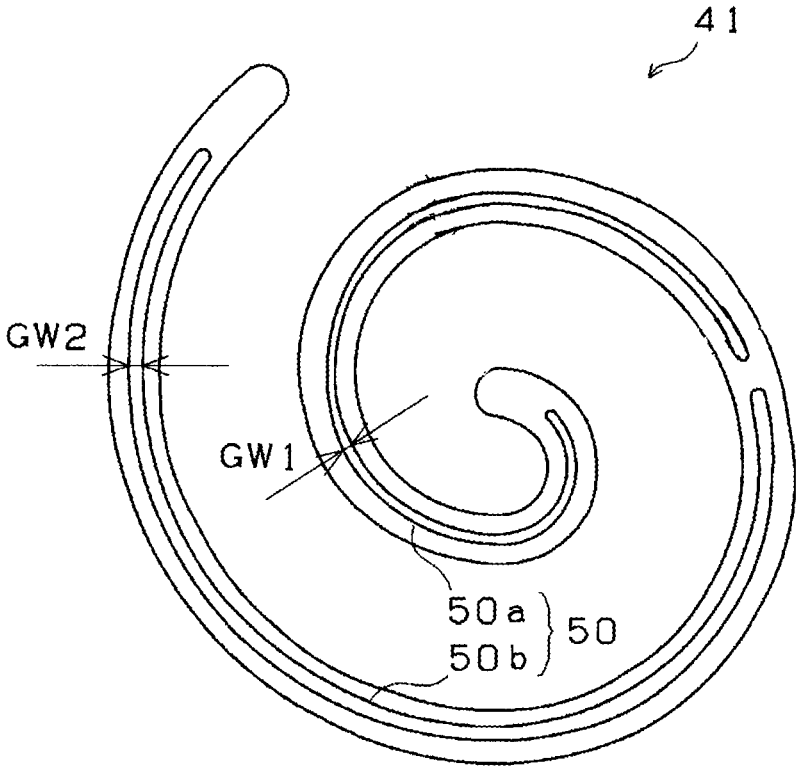
FIG. 10 is a planar view illustrating another example of a tip seal of the second embodiment.

As described above, as to the tip seal in the second embodiment, the sliding area itself is smaller than that of the conventional product without the groove due to the groove provided on the sliding surface. The dimension of the tip seal in the present embodiment illustrated in FIG. 7 and FIG. 10 is the same as that of the tip seal of a conventional product (FIG. 14), except for the presence or absence of the groove. In this case, when the real sliding area of the conventional product is taken as 100, the real sliding area in the present embodiment is 65 to 97, and the rate of the total area of the groove to the sliding surface (total area of the groove/(total area of the groove+real sliding area)×100) is 3 to 35%. Since the real sliding area becomes smaller, the surface pressure applied onto the sliding surface becomes higher thereby reducing a friction coefficient. As a result, the frictional force on the sliding surface is reduced.

Figure 11:
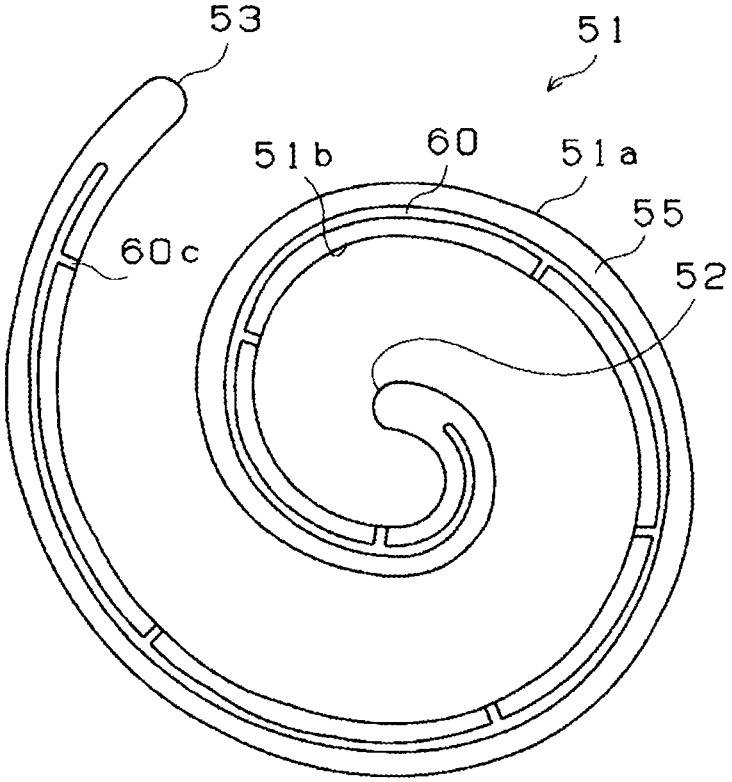
FIG. 11 is a planar view illustrating another example of a tip seal of the second embodiment.
Figure 12:
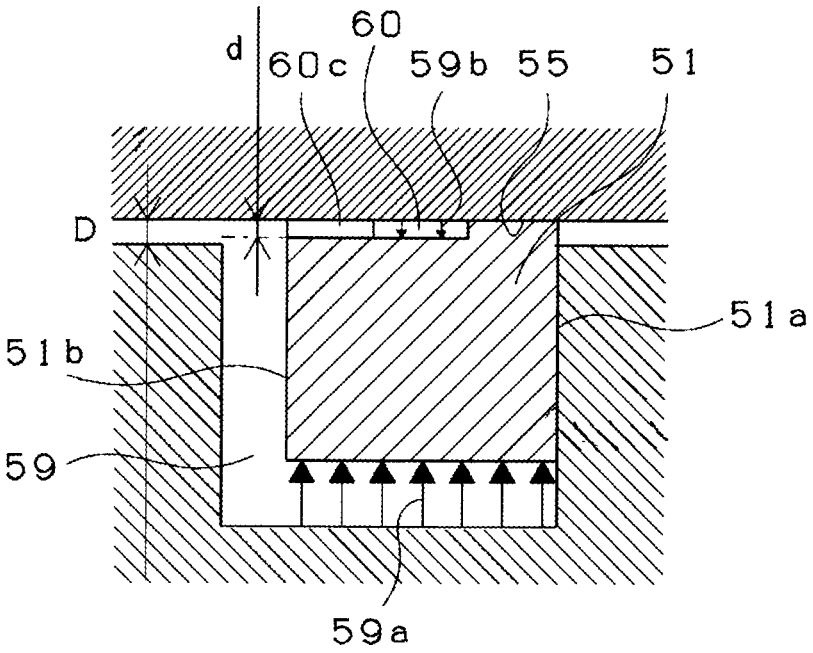
FIG. 12 is a sectional view of a state in which a tip seal is incorporated into a compressor.

Another example of a tip seal for a scroll compressor in the second embodiment will be explained based on FIG. 11. FIG. 11 is a planar view viewing the tip seal having the groove and the opening part on the sliding surface, from the side of the sliding surface and FIG. 12 is a sectional view of a state in which the tip seal is incorporated into the compressor, at a position of the opening part. As illustrated in FIG. 11, an opening part 60*c* connecting to the groove 60 is provided on the spiral inner peripheral surface 51*b* of the tip seal 51. In FIG. 11, the opening part 60*c* has a concave shape (concave part) formed by partially notching a sliding surface 55. In this way, by providing with the opening part 60*c* connecting the groove 60, even if the sliding surface 55 is in a state of sliding with other members, the groove 60 is brought into a state of communicating with a space out of the seal. Therefore, the lubricating oil is constantly supplied to the groove 60 via the opening part 60*c* and therefore, the frictional force on the sliding surface 55 can be further reduced.

In the configuration illustrated in FIG. 11, a plurality of opening parts 60*c* (the number of opening parts is 6 in FIG. 11) are separately arranged side by side on the inner peripheral surface 51*b* in a length direction from a winding-start end part 52 to a winding-finish end part 53 of the spiral of the tip seal 51. The number of opening parts 60*c* is not particularly limited, but by arranging a plurality of opening parts 60*c*, the lubricating oil smoothly goes in and comes out from the groove 60.

In a constitution provided with a plurality of opening parts, all the adjacent opening parts may be arranged at equal intervals or may be arranged at different intervals on the inner peripheral surface. In a case of the latter, in particular, in consideration of the pressure distribution described above, it is preferable to arrange the opening parts so as to widen the intervals between the adjacent opening parts continuously or stepwise from the winding-finish end part toward the winding-start end part. As described above, since high sealing performance is required for the inner peripheral part side of the tip seal, the intervals thereof are made to be wider from the winding-finish end part toward the winding-start end part and the number of the opening parts at the inner peripheral part side is fewer than that of the outer peripheral part side thereby securing the sealing performance. On the other hand, since the pressure of gas at the inner peripheral part side is higher, compared with that of the outer peripheral part side, even if the number of the opening parts is small, it is thought that the lubricating oil can be sufficiently supplied to the groove due to high gas pressure.

In addition, in a configuration illustrated in FIG. 11, the planar shape of the opening part 60*c* is made to be a rectangular shape but is not limited thereto. For example, the planar shape thereof may be made into a wedge shape and the widened side of the convex may be the inner peripheral surface 51*b* side. That is, in this case, since the opening part 60*c* has a shape in which the opening length of the opening part 60*c* is narrowed from the inner peripheral surface 51*b* toward the groove 60, the supply property of the lubricating oil into the groove 60 can be enhanced. In addition, the opening part 60*c* may have a configuration in which each opening length of the opening part at the inner peripheral part side and the opening part at the outer peripheral part side is different. For example, by making the opening length of the opening part at the inner peripheral part side to be shorter than the opening length of the opening part at the outer peripheral part side, it is possible to improve the balance of the sealing performance and the supply property of the lubricating oil.

It is preferable that the depth of the opening part 60*c* in a thickness direction of the tip seal 51 (refer to FIG. 12) is substantially the same as the groove depth d of the groove 60 or the groove depth d is slightly larger than that of the opening part 60*c*. Thus, it is possible to improve the supply property of the lubricating oil into the groove 60.

Also in a configuration of the tip seal 51, the sliding area itself becomes smaller than that of the conventional product without the groove due to the groove 60 formed on the sliding surface 55. In addition, as illustrated in FIG. 12, since the opening part 60*c* is provided, gas 59 in the compression chamber is partly introduced into the groove 60 via the opening part 60*c* in the tip seal 51. The arrows 59*a* and 59*b* in the figure indicate the pressure in which each surface receives from gas 59. In this way, the gas pressure in which the anti-seal surface of the tip seal 51 receives is partly offset by the gas pressure that has been introduced into the groove 60. However, since the lubricating oil such as a refrigerating machine oil is easily supplied onto the sliding surface, the frictional force on the sliding surface can be greatly reduced, compared with the conventional product.

In the configuration in FIG. 11 and FIG. 12, the opening part 60*c* is provided on the spiral inner peripheral surface 51*b* but may be provided on the spiral outer peripheral surface 51*a*.

In the tip seal in the second embodiment illustrated in FIG. 7, FIG. 10, and FIG. 11, the groove is formed on the sliding surface, but the groove may be formed on the anti-seal surface in addition to the sliding surface (the seal surface).

The tip seal of the present invention illustrated in the first embodiment and the second embodiment described above is preferably made of a synthetic resin and, for example, a synthetic resin such as a polytetrafluoroethylene resin, a polyphenylene sulfide (PPS) resin, a polyetheretherketone (PEEK) resin, and a liquid crystal polymer may be used. By compounding with a fibrous filler such as a carbon fiber and a whisker, a solid lubricant such as tetrafluoroethylene resin powder, and the like, these synthetic resins can be made to be resin compositions. By using a PPS resin, a PEEK resin, and a liquid crystal polymer, the tip seal can be easily produced by injection molding.

INDUSTRIAL APPLICABILITY

The tip seal for a scroll compressor of the present invention can reduce a frictional force between the scroll members and the tip seal and reduce torque of the scroll members upon scrolling while maintaining the sealing performance and therefore the tip seal can be widely applied to the scroll compressor.

The invention claimed is:

1. A tip seal for a scroll compressor comprising:

the tip seal having a spiral shape for seating a compression chamber formed between a fixed scroll and a movable scroll in the scroll compressor, said tip seat comprising a plurality of concave parts formed by partially notching a sliding surface of the tip seal to form a notched sliding surface, the notched sliding surface of the tip seal, the notched sliding surface of the tip seal engaging one of the sliding surfaces of the fixed scroll or the sliding surface of an orbiting scroll, wherein said concave parts are arranged on at least one of a spiral inner peripheral surface or a spiral outer peripheral surface, and each of said concave parts opens to the spiral inner peripheral surface or the spiral outer peripheral surface and penetrates through at least a portion of the inner peripheral surface or the outer peripheral surface, wherein a planar shape of the concave part is a circular arc shape, and circular arc radii of the concave parts, that are arranged from a winding-start end part of the spiral of said tin seal toward a winding-finish endpart of the spiral of said tip seal, are increased continuously or stepwise.

2. The tip seal for the scroll compressor according to claim 1, wherein a ratio of a total area of the concave parts to the notched sliding surface (total area of the concave parts/(total area of the concave parts+real sliding area)×100) is 5 to 45%.

3. The tip seal for the scroll compressor according to claim 1, wherein a depth of each concave part is 45% or less of a thickness of the tip seal.

4. The tip seal for the scroll compressor according to claim 1, wherein the concave parts are arranged on the notched sliding surface separately in a length direction from the winding-start end part to the winding-finish end part of the spiral of the tip seal, an opening length of each concave part is I to 20% of a total length of the tip seal obtained by measuring the total length of a center line of the tip seal, and a portion between adjacent concave parts is a part of the notched sliding surface.

5. The tip seal for the scroll compressor according to claim 4, wherein areas in a planar shape of the concave parts are substantially the same between the concave parts.

6. The tip seal for the scroll compressor according to claim 1, wherein the concave parts are arranged on the notched sliding surface at equal intervals.

7. The tip seal for the scroll compressor according to claim 1, wherein the tip seal is made of a synthetic resin.

* * * * *